United States Patent [19]

Paterson

[11] 4,016,071

[45] Apr. 5, 1977

[54] MAGNETIC SEPARATION APPARATUS

[75] Inventor: Malcolm M. Paterson, Atkinson, N.H.

[73] Assignee: Raytheon Company, Lexington, Mass.

[22] Filed: Sept. 15, 1975

[21] Appl. No.: 613,718

[52] U.S. Cl. ..... 209/39; 209/152; 209/221

[51] Int. Cl.[2] ..... B03C 1/30

[58] Field of Search ..... 209/39, 12, 224, 221, 209/152, 225, 223 R, 473, 482, 40

[56] References Cited

UNITED STATES PATENTS

| | | | |
|---|---|---|---|
| 766,718 | 8/1904 | Marsh | 209/39 |
| 1,250,554 | 12/1917 | Bryan et al. | 209/12 |
| 2,964,184 | 12/1960 | Gillette | 209/215 |
| 3,021,951 | 2/1962 | Holt | 209/221 |
| 3,595,391 | 7/1971 | Schmid | 209/39 X |
| 3,804,249 | 4/1974 | Gibbons et al. | 209/473 |

FOREIGN PATENTS OR APPLICATIONS

| | | | |
|---|---|---|---|
| 4,009 | 11/1962 | Japan | 209/224 |
| 206,610 | 11/1923 | United Kingdom | 209/224 |

*Primary Examiner*—Frank W. Lutter
*Assistant Examiner*—Ralph J. Hill
*Attorney, Agent, or Firm*—Harold A. Murphy; Joseph D. Pannone; John T. Meaney

[57] ABSTRACT

Apparatus for separating magnetic materials from non-magnetic materials in a supply of mixed waste material, comprising an inclined rotary drum having loading means for introducing a continuous flow of mixed waste materials into the drum, means for simultaneously directing a stream of air at relatively high velocity through the drum to entrain and thereby remove light materials frcm the mixture therein out of the higher end thereof, means for rotating the drum to move heavy materials toward the lower end thereof, and magnetic means for selecting magnetic materials from the separated heavy materials and removing the magnetic materials separately from the drum.

8 Claims, 9 Drawing Figures

FIG. 6
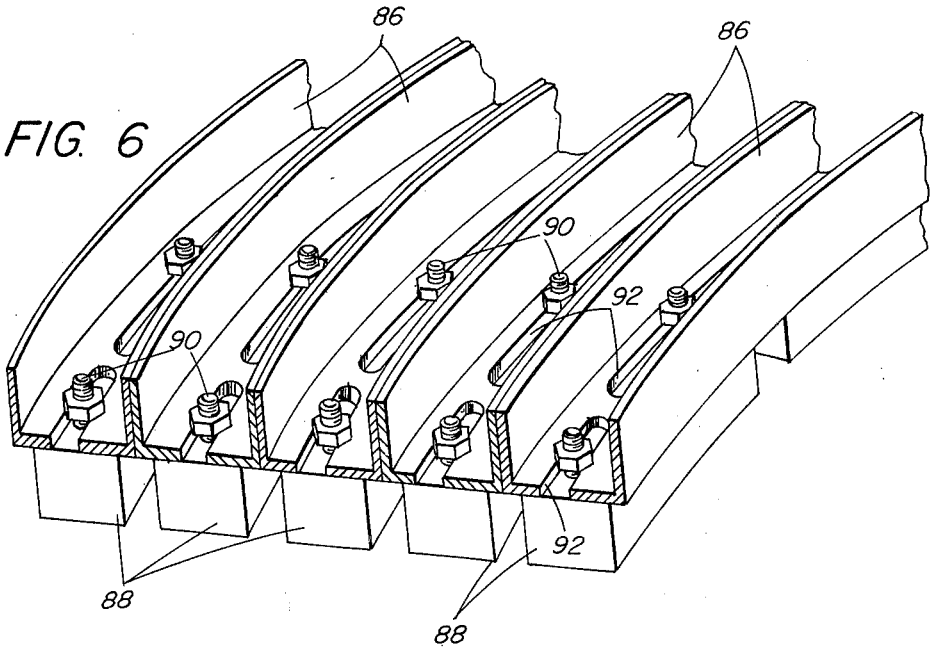
FIG. 7
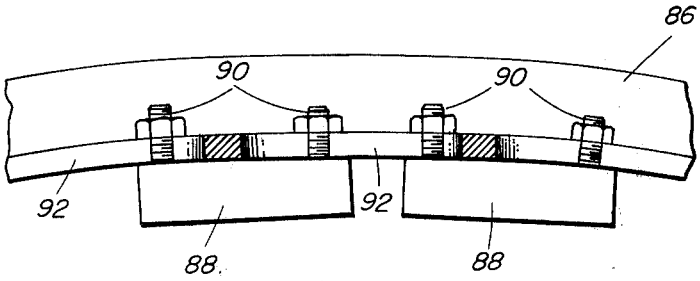
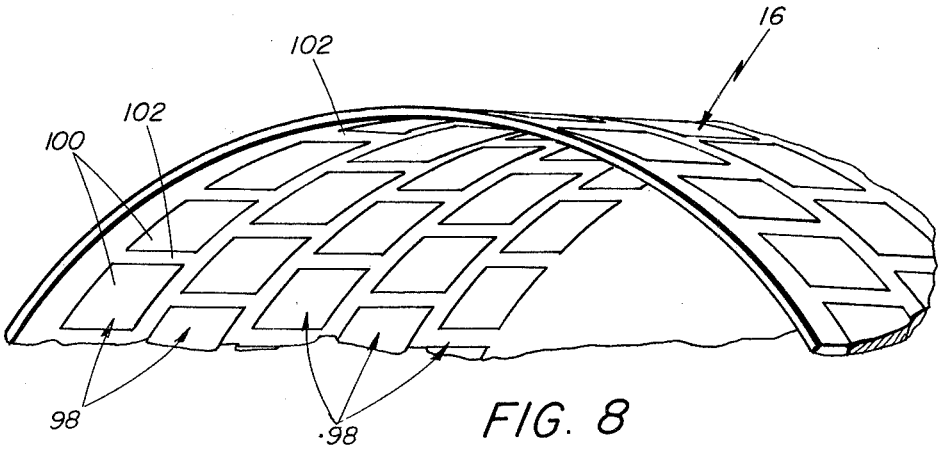
FIG. 8

MAGNETIC SEPARATION APPARATUS

BACKGROUND OF THE INVENTION

The known art of processing and separating materials in a supply of mixed materials such as commonly found in municipal waste includes apparatus which utilizes a rotary drum within which mixed materials are deposited and separated into light and heavy materials. The drum is inclined at a slight angle to the horizontal and means is provided for loading mixed materials into the interior of the drum while the drum is being rotated. The interior of the drum is provided with longitudinally extending fins or lifters which cause heavy materials to be continuously raised and dropped within the drum so that, because of the inclination of the drum, the materials will eventually work their way toward and out the lower end of the drum.

During this process a stream of air is directed at a relatively high velocity through the drum and in its passage through the drum the air stream entrains light materials and carries them out the upper end of the drum into suitable collecting means such as plenum chambers, cyclones and the like. Thus the light materials are separated within the drum from the heavy materials before the heavy materials have progressed a significant distance down the drum to be removed from the lower end thereof.

It is well known that such separated heavy materials often contain significant amounts of magnetic materials which may have considerable intrinsic values such as warrant their separation from the other materials. Therefore, means has been provided separate from the drum for separating nonmagnetic materials from the magnetic materials in the supply of heavy materials which are extracted from the lower end of the drum. Such additional magnetic separation means usually comprises relatively complicated and expensive apparatus and usually is bulky and space consuming. Some prior devices are known which receive and separate only relatively light materials such as particulates.

SUMMARY OF THE INVENTION

The above and other disadvantages of prior art separation systems are overcome in the apparatus of the present invention wherein an inclined rotary drum is utilized to separate heavy and light materials and additionally to separate the heavy materials into magnetic and nonmetallic materials, all in one operation within the single drum.

An inclined rotary drum is provided with conveyor means, particularly a screw conveyor, which deposits mixed materials into the interior of the drum. The mixed materials are tumbled by fins or lifters and as the tumbling takes place a stream of air passing through the drum at relatively high velocity entrains light materials and carries them out of the higher end of the drum to a suitable collector such as a plenum or cyclone. The tumbling action causes the heavy materials to gradually work their way down the inclined interior of the drum and eventually out the lower end where they are removed as by belt conveyors or the like.

In accordance with this invention, magnetic materials are removed from the separated heavy materials in the lower end of the drum immediately prededing the exit of heavy nonmagnetic materials from the end of the drum. This is done by magnetic means which is arranged externally of the lower end portion of the drum and partially encircling same for creating a magnetic field in the drum such as will cause pieces of magnetic material in the mixture of heavy materials to adhere to the wall of the drum and to be carried upwardly to a point where they will be disposed outside the magnetic field and will fall onto an additional conveyor for transport out of the drum to a selected location. This additional conveyor is preferably a belt conveyor which extends into the lower end of the drum only sufficiently far enough to extend axially slightly beyond the magnetic field.

The magnetic means preferably comprises a selected number of supporting rings or yokes which encircle the lower end portion of the drum parallel with each other, with permanent magnets or electromagnets being adjustably secured to the inner peripheries of the yokes in predetermined spaced relation to the circumference of the drum so as to collectively form a selected magnetic field which extends into the interior of the drum.

In accordance with this invention the entire drum or only the lower end portion of the drum may be formed of plastic, aluminum, stainless steel or other selected nonmagnetic material. In the case where the entire drum or the lower end portion of the drum is of magnetic material, such as iron or steel, for example, a number of plugs or inserts of nonmagnetic material may be disposed in closely spaced relation in openings provided therefor through the wall of the drum in the lower portion thereof. Thus, a magnetic field from the magnets will extend into the interior of the drum through the inserts.

The magnets are arranged to extend well around the bottom of the drum so that the heavy materials sliding down the lower end portion of the drum will all move into the magnetic field. At this point the magnetic materials will adhere to the wall of the drum and will be carried upwardly as the drum rotates, while the nonmagnetic materials will continue to slither down and out the lower end of the drum.

When the magnetic materials have been carried to a point which overlies the additional conveyor, they move out of the influence of the magnetic field and consequently drop onto the conveyor and are transported out the lower end of the drum separately from the nonmagnetic heavy materials.

The magnets may be adjustably mounted on their supporting yokes so as to control the intensity of the magnetic filed as desired.

BRIEF DESCRIPTION OF THE DRAWINGS

The above and other advantages of this invention will become apparent from the following description taken in connection with the accompanying drawings, wherein:

FIG. 6 is an isometric view of a portion of the magnet array and supporting yokes;

FIG. 7 is a fragmentary elevational view of a yoke and magnets supported thereon;

FIG. 8 is a fragmentary view showing a portion of a rotary drum with magnetic inserts.

DESCRIPTION OF THE PREFERRED EMBODIMENT

Figures 1, 9:
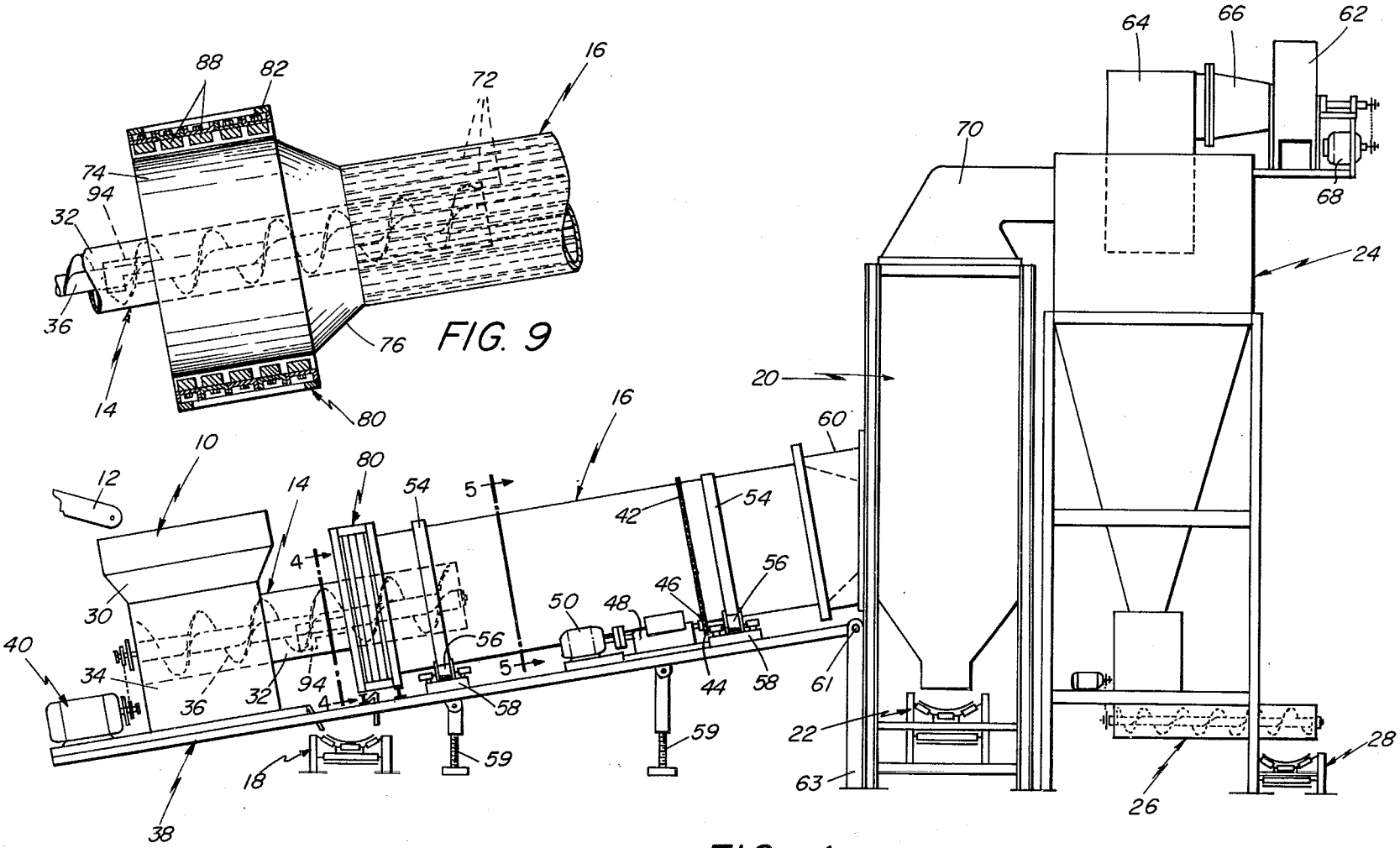
FIG. 1 is an elevational view of a materials separation apparatus employing a rotary drum embodying the invention.
FIG. 9 is an elevational view of a modified lower end portion of the drum showing the magnet array in section therearound.

Referring more particularly to the drawings wherein like characters of reference designate like parts throughout the several views, the apparatus shown in FIG. 1 includes a number of cooperating devices arranged to process and separate materials automatically in sequential fashion.

A feed hopper 10 receives shredded mixed materials from an adjacent conveyor 12 and directs it to a screw conveyor 14 which deposits it within a rotatable air drum classifier 16. The drum classifier separates the mixed materials into light and heavy materials in the known fashion of devices of this character. The drum is angled at a selected inclination, such as 10° for example, and air is caused to flow through it at high velocity. As mixed materials drop from the end of the screw conveyor onto the bottom of the drum wall, the heavy materials will be rotated upwardly with the drum to a point where they will fall to a lower point within the drum. This action is repeated until eventually the heavy materials fall out of the lower end of the drum onto a conveyor 18 which will carry them away for further processing or disposal.

The light materials will be entrained within the high velocity air stream and will be carried out the upper end of the drum 16 into a plenum chamber 20. In the plenum chamber 20 these light materials are further separated into light and medium fractions by controlling the velocity of the air stream within the chamber 20. The air stream from the drum 16 enters the plenum chamber 20 at a point in the lower regions thereof and exits at the top. Thus, by controlling the size of the chamber, and thereby the velocity of the air rising within it, the heavier of the materials entrained within the air stream will be permitted to fall by gravity to the bottom of the chamber for removal by suitable means such as a conveyor 22 for eventual reprocessing or disposal such as by incineration or other means.

The lighter fractions will continue to be entrained within the air stream and will be carried into one or more cyclone collectors 24. Such light fractions may serve many purposes and have been found particularly suitable for use as fuel. They are removed from the cyclone by a screw conveyor 26 or the like to a suitable belt conveyor 28 which will then carry them to selected supply or disposal areas.

The feed hopper 10 is provided with a bucket portion 30 at its upper end into which the mixed materials are deposited by the conveyor 12. These mixed materials have previously been shredded so that they comprise a mixture of material elements not exceeding about twelve inches in size, for example.

A feed duct of conduit 32 extends from the base 34 of the feed hopper 10 into the adjacent end of the drum 16. Within the duct 32 is a feed screw 36, one end of which is mounted in the hopper base 34 to receive the materials from bucket 30. Hopper 10 is mounted upon a suitable base of platform 38 which also supports the drum 16, as will be described.

Screw 36 is driven by a motor and chain drive 40 so that the mixed materials will be moved along duct 32 into the drum interior. The duct is preferably closed at its end within the drum, and is apertured at the bottom adjacent the end wall so that the materials will fall through the aperture onto the drum wall preferably at a point within the first third of the length of the drum.

At a selected point along its length the drum is provided with a fixed circumferential sprocket wheel 42 which meshes with a chain link drive belt 44 carried by a pair of smaller sprocket wheels 46. One sprocket wheel 46 is rotatably mounted on one end of a reduction gear box 48 which is interconnected with drive motor 50 on platform 38 whereby rotation of the drum is accomplished. The second small sprocket wheel (not shown) is supported in any suitable manner on the opposite side of platform 38 so that the drive belt is held constantly in mesh with the sprocket wheel 42.

The platform 38 and consequently the drum 16 thereon is angled to a selected inclination, such as 10° for example, To prevent longitudinal displacements of the drum there are provided two fixed restraining rings or collars 54 extending around the circumference of the drum and spaced from respective ends thereof. Each ring 54 engages a respective roller 56 mounted by suitable bearings in a support 58 carried by the platform 38. Flanges on the sides of the rollers 56 prevent longitudinal movement of the drum as it is rotated.

As shown in FIG. 1, the angle of inclination of the drum 16 may be altered to vary the velocity of the air flowing through the drum and to thereby vary the ratio of lights to heavies being separated within the drum. Such changing of the angle of inclination of the drum may be accomplished by means of jackposts 59, for example, which are suitably mounted beneath the drum 16 and attached to it.

The upper end of the drum is preferably tapered and extends into a suitable sealing ring 60 which is fixed over an inlet opening in the adjacent side wall of the plenum chamber 20.

It is important, however, to retain the upper end of the drum constantly within the sealing ring 60 in the plenum chamber 20. Therefore, the upper end of the drum is pivoted as by a suitable bearing and shaft arrangement 61 carried preferably by the adjacent end of the platform 38 and rotatably mounted at the upper ends of fixed supports or standards 63. Thus, the platform 38 can be raised and lowered by manipulation of the jackposts 59, causing the drum to be angled about the axis of the pivotal connection 61.

Air at high velocity is forced through the drum 16 by means of a fan or blower 62 which is mounted in any suitable fixed location and operatively connected to the outer end of exhaust duct 64 at the upper end of the cyclone 24 by interconnecting duct 66. The blower is operated by a motor 68 through suitable driving means so as to rotate in a manner which will suction air upwardly out of the cyclone. Such air is initially drawn into the cyclone through a duct 70 from the upper end of the plenum chamber 20.

Thus, air is also drawn upwardly out of the plenum chamber 20 and simultaneously into the plenum chamber from the rotary drum 16.

In the construction and operation of an air drum classifier of this sort, there are provided a series of spaced longitudinally extending ribs or vanes 72 on the inner wall of the drum 16 which function as lifters to raise the heavy materials, as the drum rotates, to a height from which they may be dropped again to the bottom of the drum. It will be understood that since the drum is inclined the heavy materials after each lift will be dropped nearer the lower end of the drum. Therefore, continued rotation of the drum and lifting and dropping of the heavy materials will move the materials toward the lower end of the drum until they eventually fall out of the drum onto conveyor 18. A considerable amount of the light materials emanating from the end portion of the feed duct 32 will be entrained in the high velocity air stream as the materials drop from the duct onto the drum wall and will be drawn into the plenum chamber 20. However, some small amounts of light materials will be mixed with the heavy materials falling onto the drum wall. These light materials will, of course, also be raised by the lifters and will eventually be removed by the air stream during the repetitive drops as the drum is rotated. Consequently, substantially all of the light materials will eventually be separated and drawn into the plenum chamber 20.

The lifters 72 may extend any desired distance upwardly in the drum from the point at which mixed materials are deposited in the drum by the screw conveyor 14. However in the downward direction the lifters terminate at a selected predetermined distance inwardly from the lower end of the drum. The area of the drum between the ends of the lifters and the extreme lower end of the drum is termed herein the magnetic area, to be described. Referring to FIG. 9 it will be seen that not only do the lifters 72 terminate short of the lower end of the drum, but the lower end portion 74 of the drum, the magnetic area, is of enlarged diameter. Thus, mixed heavy materials dropped from the ends of the lifters 72 will be forced by the sharply inclined connecting wall portion 76 to fall into the magnetic area 74. However, the drum need not be provided necessarily with an enlarged lower end portion since in most cases the heavy materials will continue to slither down the drum as it is rotated. Therefore, whether the lower end portion of the drum 16 is or is not enlarged, the magnetic area is to be considered as being disposed between the lower end of the drum and the adjacent ends of the lifters, but not necessarily occupying the entire distance between these two points. Substantially all, if not all the light materials will have been removed before the heavies enter the magnetic area.

The magnetic area of the drum 16 is encircled by a frame 80 (FIGS. 2 and 4) which comprises a pair of spaced four-sided supports 82 interconnected at intervals throughout the circumference of the drum by crosspieces 84. The frame 80 is mounted in any suitable manner on platform 38 so that it will constantly retain its assembled position with respect to the drum.

The frame 80 supports a selected number of parallel rings or yokes 86 which are disposed within the frame in side-by-side encircling relation to the magnetic area of the drum. In the embodiment of FIG. 9 the frame 80 and yokes 86 encircle the enlarged lower end portion 74 of the drum.

Figures 2, 3:
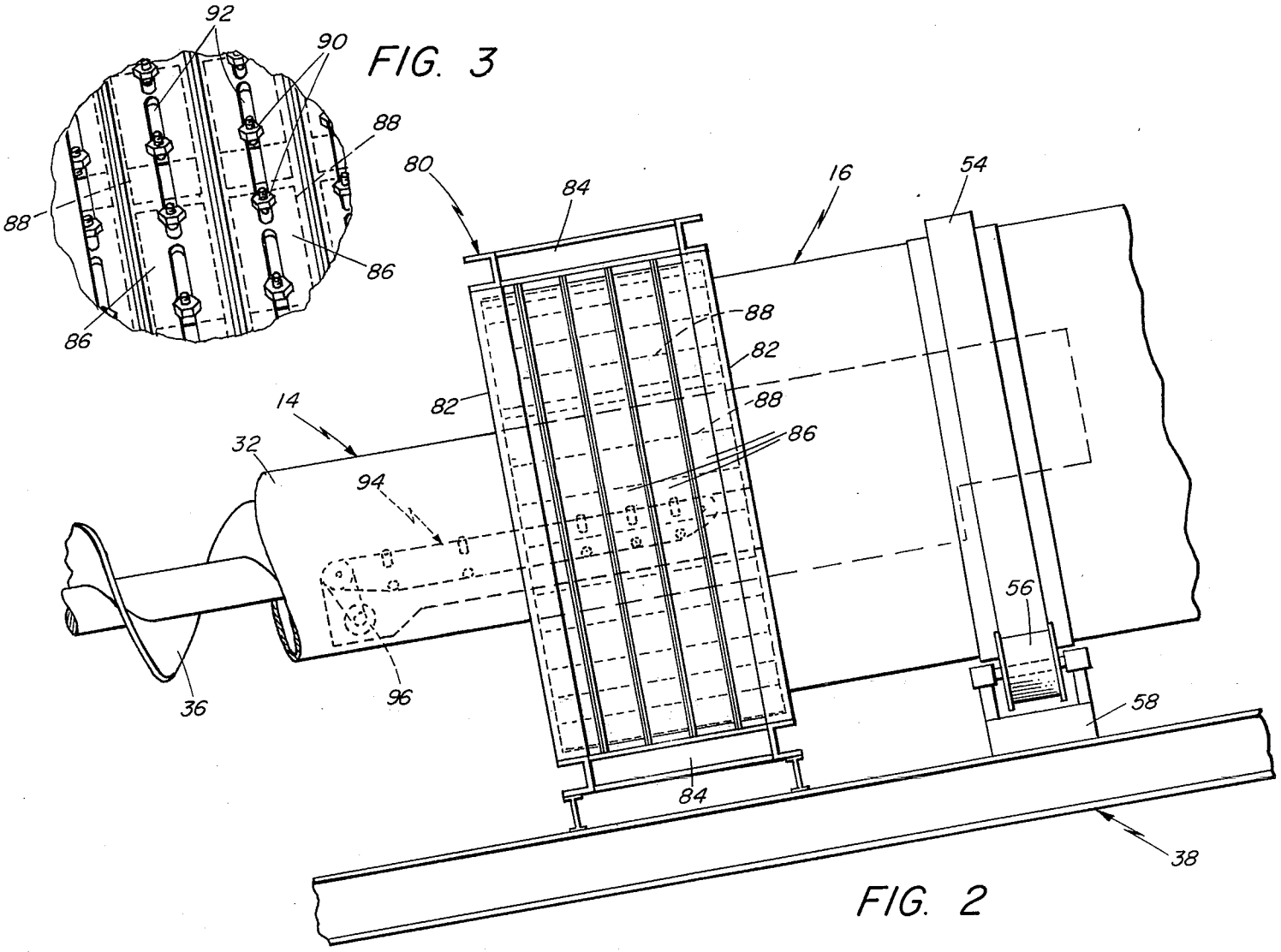
FIG. 2 is an enlarged fragmentary elevational view of the lower end portion of the drum of FIG. 1 showing the magnet array therefor.
FIG. 3 is an enlarged view of the circled portion of FIG. 2.

The supporting rings 86 are preferably channel shaped with the channels opening outwardly as shown clearly in FIGS. 3 and 6. Magnets 88 are positioned upon the inner sides of the rings and are adjustably supported in position on the rings by bolts 90 which extend through slots 92 in the bottoms of the channel-shaped rings 86. Thus, the magnets 88 may be adjusted toward and away from one another and fastened securely in place to control the intensity of a magnetic field created by the magnets. The magnets 88 may be of the permanent magnet type or may be electromagnets, as desired.

Figure 4:
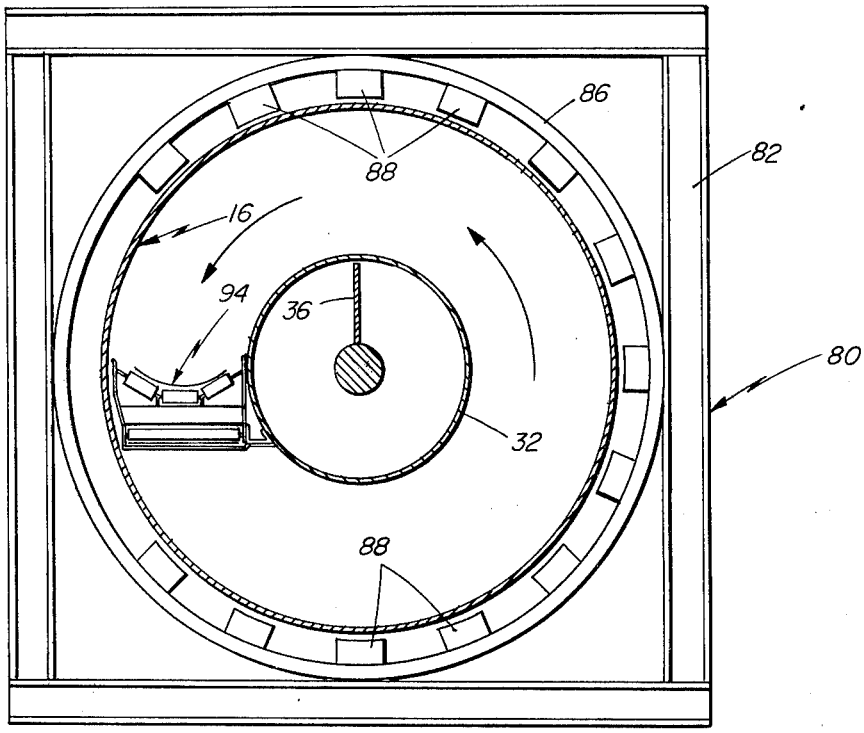
FIG. 4 is an enlarged sectional view taken substantially on line 4—4 of FIG. 1 looking in the direction of the arrows.
Figure 5:
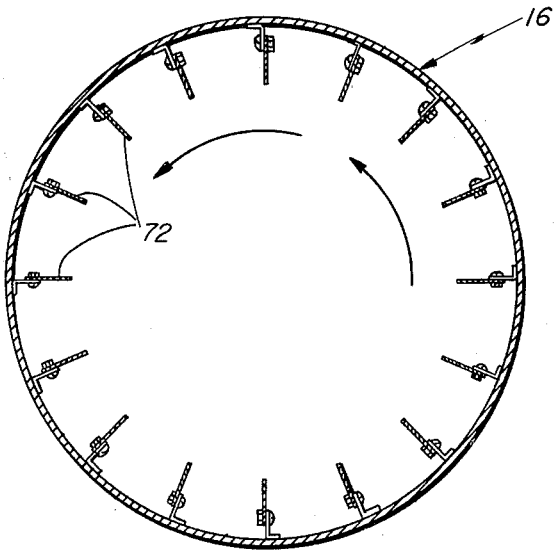
FIG. 5 is an enlarged sectional view taken substantially on line 5—5 of FIG. 1 looking in the direction of the arrows.

As seen in FIG. 4, the magnets 88 are disposed in predetermined spaced relation to the drum 16 so that the drum will freely rotate about is longitudinal axis. It will also be seen that the magnets 88 are disposed beneath the drum 16 so that their magnetic fields will extend upwardly into the drum and encompass heavy materials which are sliding down the bottom of the drum. Any magnetic materials which come into the influence of the magnetic fields will adhere to the wall of the drum while nonmagnetic materials will continue to slither down and out the lower end of the drum.

Since the drum 16 is being rotated as indicated by the arrow in FIG. 4, the magnetic materials will move upwardly and in doing so will continuously and progressively move into and through additional magnet fields until they reach a point beyond the influence of the last magnet in the array, at which point no influencing magnetic field exists and they no longer adhere to the drum wall and fall onto a conveyor 94. Conveyor 94 is preferably a belt conveyor which is suitably supported, as by the screw conveyor duct 32, so as to extend from exteriorly of the drum 16 through the lower end opening and into the magnetic area so as to intercept the magnetic materials as they fall from the drum wall when passing out of the influence of magnetic fields. The outer end of the conveyor 94 may communicate with additional conveying means or with storage means whereby the magnetic materials are kept separated from the nonmagnetic materials emerging from the drum.

Conveyor 94 may be operated by an suitable means such as motor 96 (FIG. 2).

It will be understood that the entire drum 16 may be made of nonmagnetic material such as wood, plastic, brass, lead or other nonferrous material, in which case the magnetic flux from the magnets 88 will readily penetrate into the interior of the drum to the materials therein. In cases whereby it is necessary or advisable to make the drum of ferrous material such as steel or iron, the lower end portion of the drum, at least in the magnetic area, may be made of nonferrous material.

However, in cases where the entire drum 16 is made of ferrous material, the lower end portion or the magnetic area may be provided with spaced circumferential strips 98 of nonferrous materials as shown in FIG. 8. Strips 98 preferably will be aligned with the circumferential rows of magnets. Thus, a magnetic field created by a row of individual magnets will be continuous.

The strips 98 will preferably comprise a number of discs 100 which are preferably square and are spaced apart as shown throughout the length of the strips. It has been found with discs 100 of this type and with magnets 88 properly spaced, that a slight make and break action occurs when a magnetic field is interrupted by a land 102 between discs passing over a magnet. This allows at that time a slight and temporary gravital separation of a magnetic element from the wall of the drum such as may allow the air stream to remove residual nonmagnetic material such as paper which may have become lodged between the magnetic element and the drum wall.

Accordingly, from the foregoing it will be apparent that all of the advantages and objectives of this invention have been achieved by the apparatus shown and described which provides means for first separating mixed materials into light and heavy materials, and then sequentially separating the heavy materials into magnetic and nonmagnetic materials.

It is to be understood, however, that various modifications and changes in the apparatus shown and described may be made by those skilled in the art without departing from the spirit of the invention as expressed in the accompanying claims. Therefore, all matter shown and described is to be interpreted as illustrative and not in a limiting sense.

What is claimed is:

1. A materials classifier comprising a drum disposed with its longitudinal axis inclined at an angle to the horizontal, means for rotating the drum in a predetermined direction about said axis, first conveyor means for depositing mixed materials in the drum at a selected point along its length whereby the rotation of the drum will cause a tumbling action of said materials causing the materials to progressively move toward the lower end of the drum, means for directing a stream of air at relatively high velocity through the drum to entrain light materials and remove them out the upper end of the drum, magnetic means adjacent the lower end of the drum for receiving the separated heavy materials before their exit from the drum and removing magnetic materials therefrom, and second conveyor means for transporting said magnetic materials out the lower end of the drum separately from the remaining nonmagnetic materials, said magnetic means comprising a magnet array having one end portion disposed externally of the drum beneath the heavy materials, said array extending upwardly along the side of the drum in the direction of rotation thereof, the opposite end portion of the array terminating above said second conveyor means, and the magnets on the individual rings being adjustable toward and away from each other to control the magnetic field produced thereby.

2. A materials classifier as set forth in claim 1 wherein is included longitudinally extending lifters on the inner wall of the drum for repetitively raising heavy materials to a point where they fall to a lower point in the inclined drum and progressively work their way toward the lower end of the drum.

3. A materials classifier as set forth in claim 1 wherein said magnet array comprises a series of spaced magnets encircling the lower end of the drum and defining a magnetic area therein in which the magnetic fields from the magnets extend, said heavy materials being movable through said magnetic area as they move toward the lower end of the drum, magnetic materials being separated from said heavy materials in said magnetic area, and means for separately removing said magnetic materials from the drum.

4. A materials classifier combination as set forth in claim 3 wherein the portion of said drum within said magnetic area is comprised of nonmagnetic material, and the remainder of the drum is comprised of magnetic material.

5. A materials classifier combination as set forth in claim 3 wherein the portion of said drum within the magnetic area is of larger diameter than the remainder of the drum.

6. A materials classifier combination as set forth in claim 3 wherein the drum is of magnetic material and the portion of the drum within said magnetic area includes spaced areas of nonmagnetic material embedded within the drum wall and arranged circumferentially of the drum.

7. A materials classifier as set forth in claim 3 wherein is included a plurality of longitudinally extending lifters on the inner wall of the drum for repetitively raising heavy materials to a point where they fall to a lower point in the inclined drum and progressively work their way toward the lower end of the drum, and said lifters terminate short of said magnetic area.

8. A materials classifier as set forth in claim 3 wherein said magnets are individually adjustable with respect to one another to control the magnetic fields produced thereby.

* * * * *